United States Patent [19]

Sawyer

[11] Patent Number: 5,004,153

[45] Date of Patent: Apr. 2, 1991

[54] MELT SYSTEM FOR SPRAY-FORMING

[75] Inventor: Thomas F. Sawyer, Charlton, N.Y.

[73] Assignee: General Electric Company, Schenectady, N.Y.

[21] Appl. No.: 487,095

[22] Filed: Mar. 2, 1990

[51] Int. Cl.[5] ..... B05O 1/24

[52] U.S. Cl. ..... 239/81; 239/82; 239/83; 239/135; 239/418; 75/10.14; 219/7.5; 222/593

[58] Field of Search ..... 75/10.13–10.16; 219/7.5, 8.5, 10.57, 10.67, 10.71; 373/139, 144; 222/591, 592, 593, 603, 606; 239/81–84, 135, 418

[56] References Cited

U.S. PATENT DOCUMENTS

| | | | |
|---|---|---|---|
| 2,122,241 | 6/1938 | Arnold | 373/144 |
| 2,411,409 | 11/1946 | Ballard | 219/10.57 X |
| 2,509,713 | 5/1950 | Achard | 219/10.57 X |
| 2,673,121 | 3/1954 | Brennan | 239/81 |
| 2,866,700 | 12/1958 | Bohnet et al. | 75/10.14 X |
| 2,905,797 | 9/1959 | Guyer et al. | 219/7.5 |
| 3,435,992 | 4/1960 | Tisdale et al. | 222/593 |
| 3,948,495 | 4/1970 | Cherednichenko et al. | 75/10.14 X |
| 4,354,822 | 10/1982 | Madsen et al. | 239/135 X |

FOREIGN PATENT DOCUMENTS

| | | | |
|---|---|---|---|
| 949060 | 2/1969 | United Kingdom | 373/144 |

*Primary Examiner*—Andres Kashnikow
*Assistant Examiner*—Kevin Weldon
*Attorney, Agent, or Firm*—Paul E. Rochford; James Magee, Jr.; James C. Davis

[57] ABSTRACT

A method for regulating the flow of liquid metal to an atomization zone is provided. The regulation is effected by imparting a high density flux to a stream of liquid metal as it descends toward the atomization zone. The high density flux is applied by a flux concentrator. The flux concentrator is a small sleeve-like element attached by parallel conductors to a larger sleeve-like element which acts as a secondary to primary coil extended through the larger sleeve element. By imparting high density flux to initiate a stream passing through the flux concentrator the cross sectional dimensions of the melt stream and the rate of flow of melt through the concentrator is regulated to values which are appropriate for a spray-form type of action.

5 Claims, 2 Drawing Sheets

MELT SYSTEM FOR SPRAY-FORMING

CROSS-REFERENCE TO RELATED APPLICATIONS

The subject application is closely related to copending application Ser. Nos. 487,094 filed 3/2/90; 487,511 filed 3/2/90; and 489,300 filed 3/5/90. The copending applications are incorporated herein by reference

BACKGROUND

The present invention relates to apparatus useful in supplying a molten stream of metal to a spray-forming station.

More particularly it relates to an apparatus adapted for melting metal and for supplying a stream of molten metal to a gas atomization component of a spray-forming-apparatus.

It is well-known that spray-forming is a process which is carried out by developing a supply of liquid metal and by flowing a stream of the liquid metal into the path of the atomizing gas. The atomizing gas breaks up the single stream of molten metal into many tiny droplets. The spray-forming process involves the interception of the flight of these droplets before they turn to particles while in flight, and depends on the solidification of the droplets as they impact on a receiving surface. Spray-forming in this manner is a well-developed art and numerous articles can be formed from this spray deposit of this type process.

Normally the development of a liquid stream of molten metal requires that the molten metal be dispensed from a crucible either by pouring from the top of the crucible through a spout or by pouring from the bottom of the crucible through a suitable opening. The molten metal, particularly for the higher melting metals, requires that the crucible be formed of very high melting material and ceramic is the normal and natural choice of materials for such crucibles.

One problem which arises from the use of ceramic crucibles is that due to thermal shock or due to abrasion or some similar mechanism there is a possibility that a small ceramic particle will enter into the melt stream exiting from the crucible and will be incorporated in an article made by the spray-forming process. The problem which arises from the presence of such particles in an article formed by spray-forming is that it can serve as the locus from which cracks develop and spread. It is generally well recognized that a foreign material such as a particle of ceramic can serve as the focal point around which cracking develops in an article manufactured for use under high stress conditions. Such high stress may occur for example if the particle is embedded in a moving part of an aircraft engine where the part may rotate at speeds of 12,000 revolutions per minute or more. For stationary or static parts of apparatus and those which are subjected to low stress, the crack formation and propagation is not as great a danger. However the problem is that it is difficult in a ceramic lined system to determine just when the ceramic flake or particle will separate from the container and enter the stream. For this and other reasons the quest for an ultraclean melting system has been of concern to many researchers and metal suppliers and activity in this area during recent years has been increasing. This effort has been directed toward drastically reducing or eliminating crack initiation sites from parts in which a ceramic inclusion may be picked up in the melt cycle and carried through to a casting or to a spray-forming cycle.

It is recognized that ceramic inclusions tend to have a density which is lower than that of the host metal melt in which they are included. For this reason there is a benefit obtained in avoiding top pour processing of molten metal as the particles are more likely to be included in a stream emanating from the top of a crucible than one which emanates from the bottom. While the particles tend to congregate at the top of a melt the stirring action which may attend the flow of the melt or which may attend induction power supply may not allow all particles to remain on top of the melt. Also particles splintered from a cracked crucible or cement used to adhere the nozzle and crucible together may also be swept into the melt stream as it emerges from the crucible nozzle at the bottom of a crucible. For this reason what I have developed here is in effect a ceramicless melt system.

The Duriron Company, Inc., of Dayton, Ohio has published a paper in the *Journal of Metals* in September 1986 entitled "Induction Skull Melting of Titanium and Other Reactive Alloys" by D. J. Chronister, S. W. Scott, D. R. Stickle, D. Eylon and F. H. Froes. In this paper an induction melting crucible for reactive alloys is described and discussed. In this sense it may be said that through the Duriron Company a ceramicless melt system is available. The present invention provides a method and apparatus which is an alternative to and improvement over the skull melting method and apparatus of the Duriron Company.

The controlled atomization of a liquid stream of metal and its deposition on a substrate by a spray-forming process requires that the molten stream of metal pass through a nozzle with a predetermined fixed bore size

BRIEF DESCRIPTION OF THE INVENTION

Accordingly it is one object of the present invention to provide a scheme by which a stream of metal of a predetermined diameter can be formed.

Another object of the present invention is to provide a means for regulating the flow of liquid metal to an atomization zone to be sure the diameter of the stream is within a specified size range.

Another object of the present invention is to provide apparatus which permits the size of a stream of molten metal to be controlled.

Other objects will be in part apparent and in part pointed out in the description which follows.

In one of its broader aspects objects of the present invention can be achieved by providing a source of liquid metal and by providing means of directing the liquid metal in a stream to a magnetic nozzle to permit said nozzle to act on said stream. The nozzle has a high density flux established therein by means of an arrangement of electrical elements. The first of these elements is a primary induction coil having a multiplicity of helical windings. A secondary induction coil has a single winding. The secondary induction coil is in the form of two connected sleeves. The first of the sleeves is larger in height and in diameter and surrounds the primary induction coil to receive electrical flux emanating therefrom. The second of the sleeves serves as the magnetic nozzle and is smaller in height and diameter than the first sleeve and is spaced therefrom. Each of the sleeves has an axially aligned slit in the wall surface thereof which faces the other sleeve. The sleeves are connected by a pair of side by side parallel strip conductors having a strip height approximating that of the second sleeve. The second sleeve, which serves as the magnetic nozzle has an internal conical surface terminating in an opening slightly larger than that of the desired diameter of the stream of metal to pass therethrough. When a flux is generated in the primary winding a high density flux is developed as a result along the axis of the second sleeve in the region where the stream of liquid metal is to pass therethrough. The result is the control of lateral dimensions of the stream to close tolerances and also the positioning of the stream in the center of the second sleeve opening.

BRIEF DESCRIPTION OF THE DRAWINGS

The description of the invention which follows will be understood with greater clarity if reference is made to the accompanying drawings in which.

DETAILED DESCRIPTION OF THE INVENTION

One of the main functions of an apparatus and method as provided pursuant to this invention is to permit the continuous supply of relatively larger quantities of molten metal to a spray-forming apparatus so that articles of larger dimensions can be spray-formed using the conventional spray- forming technology. Until the present time the dimensions of spray formed articles have been limited by the limits of capacity of melting apparatus where such melting is accomplished by heating a quantity of metal in a ceramic vessel by induction heating or by heating metal in a vessel as outlined in the *Journal of Metals* article referred to in the background statement of the present invention. What can be accomplished through the means and method of the present invention is a continuous supply of a metal, including a reactive metal such as titanium or zirconium, to a spray-forming apparatus where the spray-forming can convert the stream of molten metal into a deposit of a preform on a receiving surface. For example using the method and apparatus of the present invention it is possible to make a preform on a mandrel which is extensive in both thickness and length and which employs a large quantity of metal in the deposit amounting to quantities in excess of those which have been readily available by prior art methods.

This apparatus and method is now described with reference to the figures.

Figure 1:
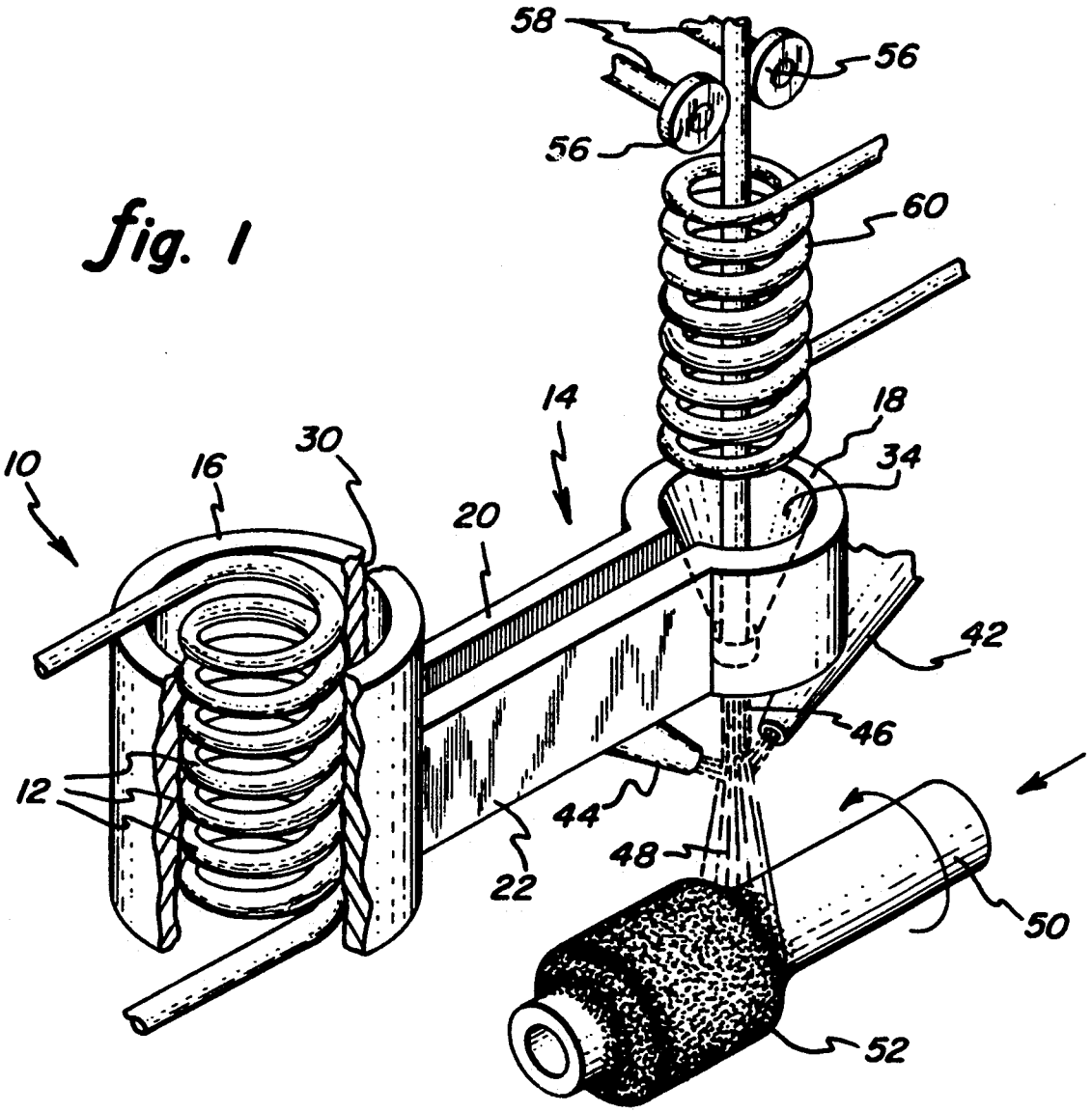
FIG. 1 is a perspective view in part in section of the apparatus of the present invention.

Referring now first to FIG. 1, one form of the apparatus of the present invention is illustrated in a perspective view. The principal elements which form parts of the present apparatus include a primary winding 10 having several individual helical coils 12 and a secondary winding 14 having relatively a unique shape. The element 14 constitutes in one sense a single turn secondary of the multi-turn coil primary 10. The single turn secondary 14 is made up of two sleeves 16 and 18 connected by two conductive strips 20 and 22. The sleeve 16 is the larger of the two sleeves and essentially surrounds the multi-turn coil 12. Some of these elements are better seen in their relation by reference to FIGS. 2 and 3 in which the same reference number in the several figures refers to the same part of the apparatus.

Figure 2:
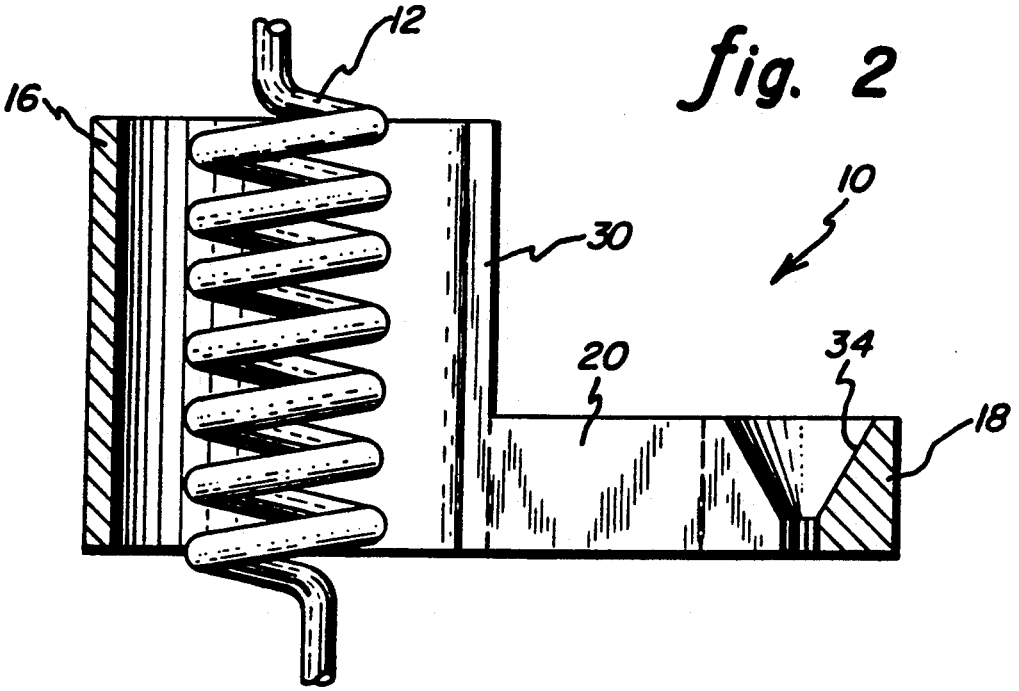
FIG. 2 is a side elevation also in part in section of a portion of the apparatus as illustrated in FIG. 1.
Figure 3:
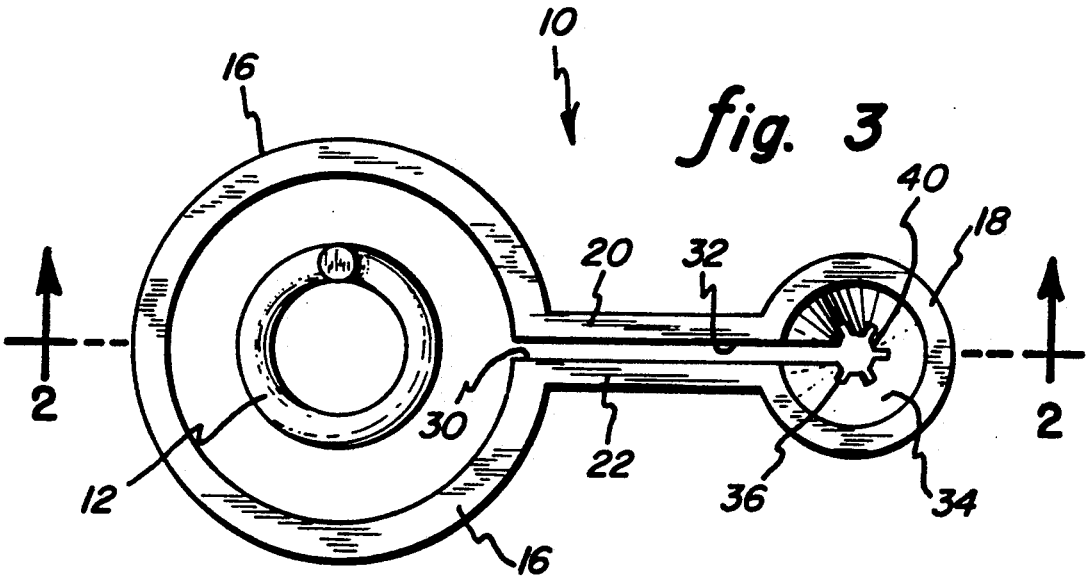
FIG. 3 is a top plan view of the apparatus of FIG. 2.

With further reference now to FIGS. 2 and 3, the coil 12 can be seen to reside within the center of the sleeve 16. Sleeve 16 has a side opening slot 30 which extends for the full depth of the sleeve. The slot appears in the side of sleeve 16 where it faces the sleeve 18. Similarly the sleeve 18 has a side opening slot 32 which extends the full depth of the sleeve 18 at the portion thereof which faces the sleeve 16. The two sleeves are connected electrically by the two parallel strips 20 and 22 which are themselves separated by a distance equivalent to the width of the slits 30 and 32 in the respective sleeves 16 and 18 respectively. The sleeve is shaped on its internal surface to a center opening funnel 34. In addition a number of slots 36 are cut into the lower end of the funnel to provide a roughly star shaped opening from the funnel at the lower extremity of the sleeve 18. The slots 36 in the funnel shaped wall of sleeve 18 are positioned to produce high density flux in the lower portion of the sleeve 18.

When the primary coil 12 is energized the result is that flux lines are generated in a coil 12 and this induces high currents in the secondary coil 16. The high currents in the secondary 16 in turn produces high density flux at the flux concentrator element 18. The slots 36 are designed to regulate the strength of this high density flux to act on a stream of liquid metal flowing downward through the flux concentration sleeve 18.

The action of the concentrator sleeve 18 on the high density flux is two fold.

The first influence of the flux concentrator sleeve is to help melt and maintain a continuous volume of molten metal while smoothing out the rate of flow of the metal stream so that it does not fall in a fashion a string of segments or droplets of liquid metal. Rather the stream is maintained as a coherent continuous stream which is centered through the flux concentrator 18 and which emerges from the concentrator and is directed into the atomization zone there beneath.

Its second action is to center the liquid metal streams accurately within the defined opening 40 of the flux concentrator 18. In other words the desired flow of the liquid metal stream is through the axis of the sleeve 18. Where the metal stream flow is not axially to the sleeve 18 the flux concentrator acts on the stream to divert and direct it precisely through the center of the flux concentrator 18.

The atomization of the melt stream is illustrated in FIG. 1 where two gas nozzles 42 and 44 are shown in a position to cause the melt stream 46 to be broken up by the jets into a diverging cone 48 of droplets of molten metal. These droplets are rapidly solidified as they come into contact with a receiving surface. The receiving surface illustrated in FIG. 1 is a mandrel 50 which is rotated and which is moved axially to present a fresh surface to the descending atomized melt stream and to form a spray-formed deposit 52 on the surface of the mandril progressively as the mandril is moved to the left in the drawing as indicated by the arrow. It is important to note that because of the high volume of metal which can be supplied through the practice of the present invention, preforms of substantial metal mass or metal volume can be formed employing the method and apparatus of the present invention. The preforms themselves are found to be formed in a very regular form and of extended length depending on the time during which the spray-forming is carried out.

Regarding the metal supply to the flux concentrator funnel 18 the scheme which is shown in FIG. 1 involves the use of a descending melt rod 54 which is moved downward at a predetermined rate by a set of rollers 56 mounted on the axles 58 and activated by a drive source which is not shown. As the rod 54 descends by action of the rollers 56, it passes through a coil 60 which is supplied with high energy high frequency flux so that the rod within the coil is itself heated. The heating is carried to just below the melting point and as the rod 54 passes through the funnel 34 of the flux concentrator sleeve 18 it becomes molten as it enters into the opening 40 at the bottom center of the flux concentrator sleeve 18.

Alternatively a supply of liquid metal can be made in more conventional fashion so that the liquid metal arriving at the flux concentrator 18 is liquid when it arrives there. The flux concentrator 18 nevertheless provides a function of regulating the lateral dimensions and essentially the cross section of the melt stream and also regulating the flow of melt through the flux concentrator. Such conventional form of liquid metal may be such as is described in the Duriron company article in the *Journal of Metals* as set forth above and the background of the subject specification.

What is claimed and sought to be protected by Letters Patent of the United States is as follows:

1. Apparatus for forming a continuous liquid metal melt stream of closely defined lateral dimensions which comprises, a source of liquid metal, means for directing said metal in a stream to a magnetic nozzle to permit said nozzle to act on said stream, a primary induction coil having a multiplicity of helical windings, a secondary induction coil having a single winding, said secondary induction coil being in the form of two connected sleeves, the first of said sleeves being larger in height and diameter and surrounding the primary induction coil, the second of said sleeves being smaller in height and diameter and being spaced from the first sleeve, each of said sleeves having an axially aligned slit in the portion of the wall surface thereof facing the other sleeve, said sleeves being connected by a pair of side by side parallel strip conductors having a height approximating that of the second sleeve, and said second sleeve having an internal conical surface terminating in an opening slightly larger than that of the desired diameter of the stream of metal to pass therethrough, whereby a high density flux is developed along the axis of the second sleeve to cause said second sleeve to serve as a magnetic funnel and to to control the dimensions of a liquid metal stream passing therethrough.

2. The apparatus of claim 1, in which the two sleeves are parallel to each other and spaced laterally from each other.

3. The apparatus of claim 1, in which the multiplicity of windings is chosen to optimize the matching of impedances of the primary and secondary coils.

4. The apparatus of claim 1, in which the internal conical surface of the second sleeve is provided with axial slits to concentrate the magnetic flux therein.

5. The apparatus of claim 1, in which the two sleeves are in side-by-side parallel relation and the connection therebetween is a lateral connection.

* * * * *